US005513413A

United States Patent [19]

Myers et al.

[11] Patent Number: 5,513,413

[45] Date of Patent: May 7, 1996

[54] FLOOR MACHINE SPLASH GUARD

[76] Inventors: Tom Myers, 2852-C2 Walnut Ave., Tustin, Calif. 92680; Laura Dexter, 3201 E. Hiway 70, Safford, Ariz. 85546

[21] Appl. No.: 421,807

[22] Filed: Apr. 12, 1995

[51] Int. Cl.[6] ..... A47L 11/162

[52] U.S. Cl. ..... 15/246; 15/50.1; 451/455

[58] Field of Search ..... 15/246, 50.1; 451/455

[56] References Cited

U.S. PATENT DOCUMENTS

| | | | |
|---|---|---|---|
| 1,417,926 | 12/1922 | Dixon | 15/246 |
| 2,981,966 | 5/1961 | Beffel | 15/246 |
| 3,010,135 | 11/1961 | Pollnow | 15/246 |
| 3,122,769 | 3/1964 | Doersam | 15/246 |
| 3,153,251 | 10/1964 | Ohlson | 15/50.1 |
| 3,733,635 | 5/1973 | Carden | 15/246 X |
| 4,330,897 | 5/1982 | Tucker et al. | 15/246 |
| 5,280,663 | 1/1994 | Proulx | 15/246 |

*Primary Examiner*—Chris K. Moore

*Attorney, Agent, or Firm*—Patent Law & Venture Group; Gene Scott

[57] ABSTRACT

An improved splash guard designed to prevent wax, cleanser, debris and the like from being spattered from a floor cleaning apparatus, the guard consisting of an elongate strip of flexible, waterproof material with a length greater than a peripheral base of standard floor cleaning apparatus and a width greater than the height of the apparatus so that the strip is capable of encircling the apparatus to form an enclosed wall adapted to the general shape of the peripheral base, extending generally from the floor up to the height of the housing of the apparatus. A bottom, straight edge of the strip is designed for constant, sliding contact with the floor, and thus preferably includes a strip of low friction material which also retards debris adherence. The ends of the strip are secured together with a two-part fastener that secures the ends adjustably and removably.

13 Claims, 4 Drawing Sheets

FLOOR MACHINE SPLASH GUARD

BACKGROUND OF THE INVENTION

1. Field of the Invention

This invention relates generally to splash guards, and more particularly to a device designed to be used in conjunction with a rotary floor cleaning apparatus so as to prevent cleansing material or debris from being splattered onto walls and other surfaces adjacent to the surface being cleaned.

2. Description of Related Art

Standard floor polishing and cleaning apparatus typically utilize a single brush or a pair of rotary brushes mounted for rotation against a floor surface to be cleaned, polished or waxed. Due to the rapid rotation of the brushes, cleansing materials, as well as particles of debris, are frequently emitted from the brushes at a velocity great enough to spatter walls, furniture and other objects and surfaces. This is particularly undesirable, as the splattered area or objects then need to be re-cleaned, resulting in time consuming, unnecessary and inefficient work. In addition, the splattered material can stain or otherwise damage baseboards, furniture and the like.

Thus, there is a need for a specialized splash guard designed to prevent this undesirable splattering of material from the cleaning apparatus. Doersam U.S. Pat. No. 3,122,769 introduces a splash guard that consists of a vertical wall member shaped so as to completely but somewhat loosely surround the lowermost portion of the apparatus housing that supports the rotary brushes. An integral flange extends at right angles from one of the two edges of the wall member and the other of the two edges is notched so as to provide openings of a limited size. These openings are adapted to permit liquid to enter and leave the scrubbing area when the splash guard is in an operative position with the flanged edge up.

However, there are several problems that plague this splash guard. First of all, it has a rigid structure and shape, thus limiting it to use only in conjunction with cleaning apparatus of approximately the same shape and size. Secondly, the rigidity of the device makes the guard difficult to conveniently store between uses. In addition, the device is constructed of rigid plastic or the like that is susceptible to cracking or breaking under the strain of impact during floor operations.

Thus there is a clear need for an improved splash guard that overcomes these difficulties. The present invention fulfills these needs and provides further related advantages as described in the following summary.

SUMMARY OF THE INVENTION

The present invention is an improved splash guard designed to prevent wax, cleanser, debris and the like from being spattered from a floor cleaning apparatus so as to prevent furniture, walls and other items from being stained while also significantly improving the efficiency of the floor cleansing process.

The splash guard consists of an elongate strip of flexible, waterproof material that is easily formed into a cylindrical shape and thereafter unfolded for storage in the flattened position. Thus, it is an object of the invention to provide a splash guard that takes up little space during storage.

The elongate strip has two end edges and a top and bottom edges. The strip is manufactured with a length greater than the peripheral edge of standard floor cleaning apparatus and a width greater than the height of the peripheral edge of such devices.

To use the splash guard, the two ends are simply secured together around the apparatus so that the strip adapts to the general shape of the apparatus but does not restrict its operation. The bottom edge of the guard is straight, and may have a strip of low friction material secured to it. The low friction material ensures that the bottom edge of the splash guard maintains intimate contact with the floor during use. Thus, when properly positioned, the strip forms an enclosed wall around the apparatus that extends from the floor up to a height necessary to prevent splashed material from passing the guard. As the apparatus is moved over the floor's surface, it pushes the guard along the floor with it so that any splattered material contacts and is retained by the inside of the guard. The low friction material overcomes a major problem with prior art devices in that splattered debris does not stick to it so that the guard is able to avoid splatter build-up and thereby retain a low friction floor contact.

To ensure that splattered material is properly retained, the ends of the strip must be secured together so that there is an appropriate distance between the peripheral edge of the apparatus and the strip. Thus, the connecting means must allow the ends to be easily adjusted, overlapped and removed as necessary. Preferably, the connecting means is a hook and loop type fastener, such as VELCRO®.

Thus, it is an object of the present invention to improve significantly over prior art guards by providing a single guard that can be easily used in conjunction with cleaning apparatus of a variety of different sizes. It is another object of the invention to be composed of a flexible material, such as thin plastic, that is able to roughly conform to a variety of floor apparatus. Thus, the present invention is a significant improvement over prior art devices in that a single guard can be used in conjunction with a wide variety of different types of machinery.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the invention, a splash guard. In such drawings.

DETAILED DESCRIPTION OF THE PREFERRED EMBODIMENT

FIGS. 1–4 show one preferred mode of the present inventive adjustable splash guard 5 to be used in conjunction with a floor cleaning apparatus 10. The splash guard 5 is designed to enclose the apparatus 10, thus preventing splashing or scattering of cleansing material or debris which is generated during cleaning operations.

Figure 1:
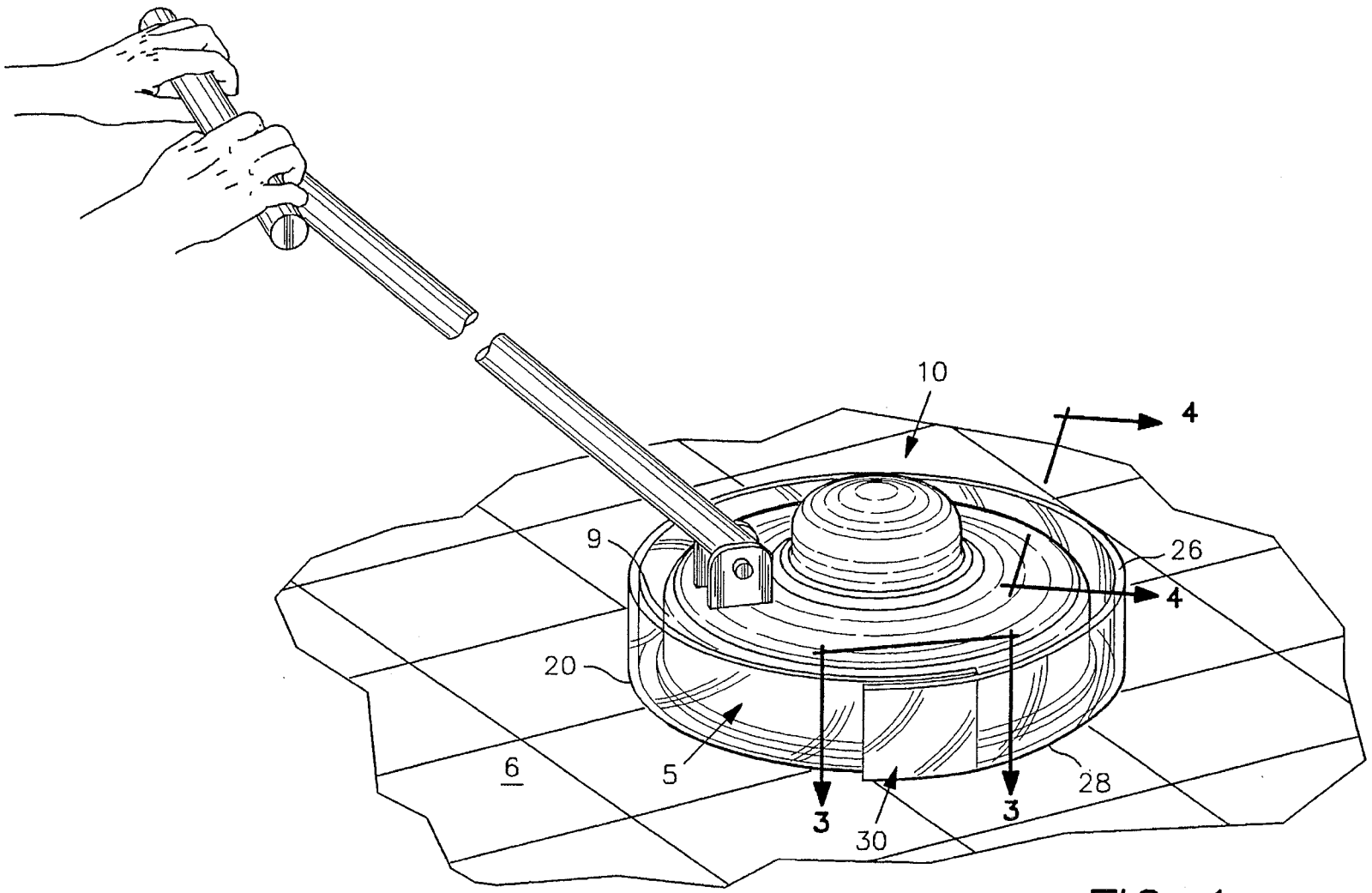
FIG. 1 is a perspective view of a preferred embodiment of the present invention, particularly showing the splash guard as properly secured around a floor cleaning apparatus without contacting it.
Figure 4:
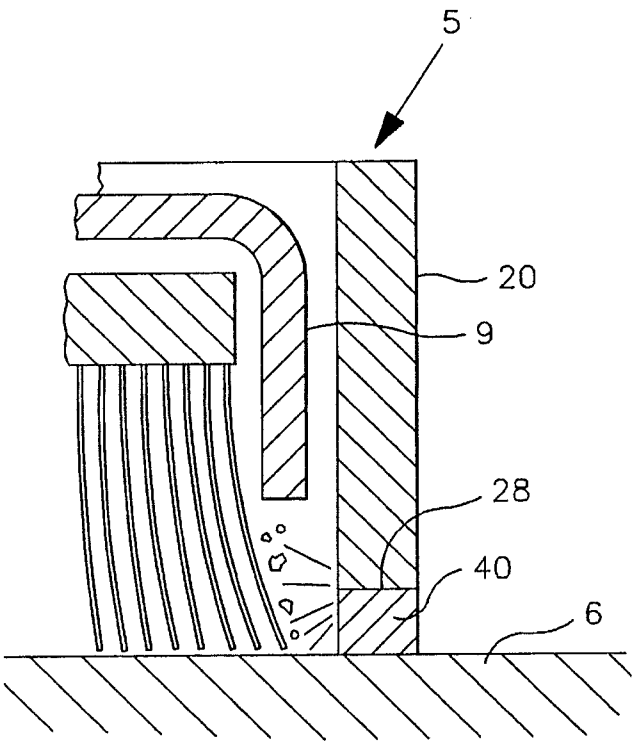
FIG. 4 is a partial cross-sectional view taken along line 4—4 of FIG. 1 and particularly disclosing the relative positions of a housing and rotating brush of a floor machine apparatus with respect to the present invention splash guard.

To best understand the proper functioning of the present invention, a brief description of standard floor cleansing apparatus 10 is beneficial. Essentially, the apparatus 10 consists of one or more rotary brushes that spin rapidly about a vertical axis. Cleaning or floor finishing material is generally poured onto a floor surface 6 so that as the apparatus 10 is pushed over it the brushes work the material into the floor 6 or create a finished wax surface. The apparatus 10 includes a cover that surrounds the brushes and a motor housing. The cover is essentially designed to protect the motor housing and keep cleansing material and debris emitted by the rotating brushes from spattering across the floor 6, and onto walls, furniture, etc. As illustrated in FIG. 4, the cover provides a peripheral base 9 with a height and perimeter great enough to appropriately enclose the brushes. However, as illustrated, a problem is frequently incurred in that the brushes are in contact with the floor 6 but the apparatus' peripheral base 9 is not, thus allowing flying particles of wax, debris and the like to escape through this gap and spatter across the floor 6. The present inventive splash guard generally consists of a flexible elongated strip 20 of waterproof material having a thickness preferably of between ⅛ and ¼ inch, as this thickness range has been shown to provide the best compromise in flexibility, weight, toughness and resilience so as to provide a superior guard having working qualities of unique value. Other material thickness have been tested but have not provided the improved qualities necessary for commercial success with this guard. As illustrated in FIG. 1, the length of the strip 20 is greater than the perimeter of the peripheral base 9 of the cleaning apparatus 10 so that the ends may be overlapped for attachment onto the floor apparatus, and the width of the elongated strip 20 is generally greater than or equal to the height of the peripheral base 9 so as to assure that debris is not able to escape the guard in operation of the floor cleaning apparatus 10. The strip 20 is designed to loosely encircle the apparatus 10 so as to adapt to the general shape of the apparatus' peripheral base 9. The strip 20 has two ends, 22 and 24, and a top 26 and bottom 28 edge. The two ends 22 and 24 include a connecting means 30 that allows them to be easily secured to one another. The bottom edge 28 of the strip 20 is straight, so that in use the entire bottom edge 28 of the strip 20 is capable of maintaining intimate contact with the floor 6. Thus, when properly positioned, as seen in FIG. 1, the strip 20 forms an enclosed wall extending from the floor 6 up to a height sufficient to prevent debris from being ejected from the machine. This enclosed wall prevents spattering by retaining debris and cleaning material inside the elongate strip 20.

Figure 2A:
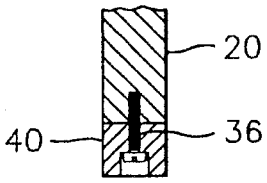
FIG. 2A is a partial cross-sectional view of a lower portion of the guard of FIG. 1 taken along line 2A—2A, and showing one means for attachment of a low friction strip of the invention, to a bottom surface of the guard.
Figure 2:
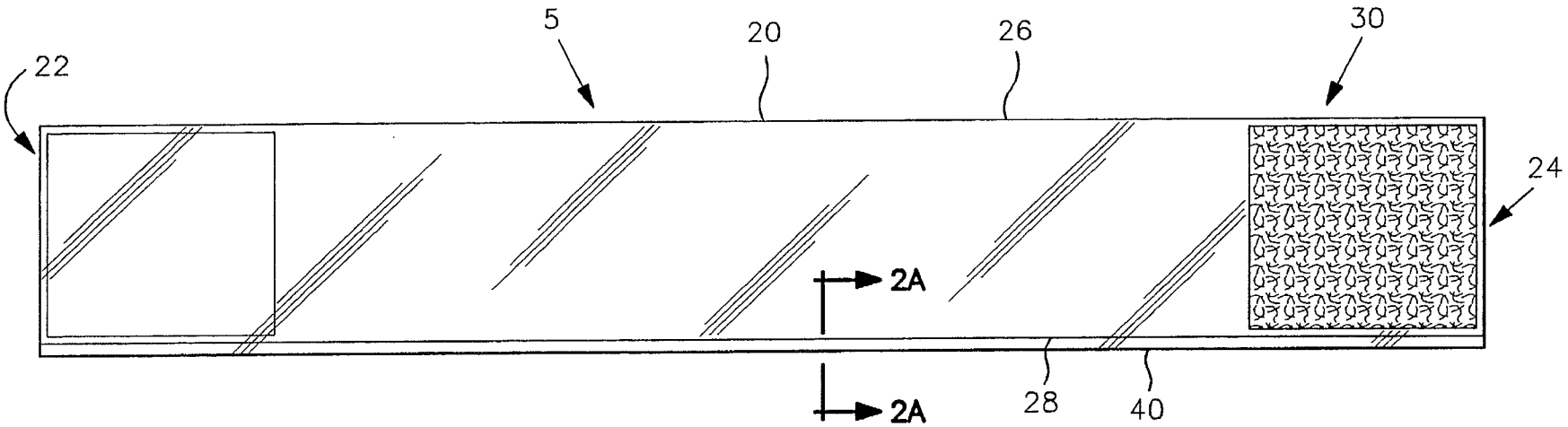
FIG. 2 is an elevational view of the guard of FIG. 1 showing the relative positions of a two part attachment means and a low friction strip of the invention.

Obviously then, it is essential that the bottom edge 28 of the strip 20 maintains contact with the floor 6 during the cleaning process so that material emitted from the brushes cannot escape from beneath the strip 20. To ensure that the invention maintains close contact with the floor 6, a strip of low friction material 40, capable of maintaining sliding contact with the floor 6, is preferably secured along the strip's bottom edge 28, as illustrated in FIGS. 2 and 4. The low friction material strip 40 is preferably between ⅛ and ¼ inch in height, said height range being found to be an advantageous size for preventing adherence of floor debris thereon. The strip 40 is preferably fabricated of a moisture resistant polymer fiber having low friction properties such as TEFLON®. This low friction material does not easily allow debris to build-up on its surfaces and therefore maintains a smooth undersurface for continued intimate contact with the floor 6.

In addition to maintaining constant contact with the floor 6, it is also crucial that there is an appropriate minimum amount of horizontal space maintained between the strip 20 and the peripheral base 9 of the apparatus 10. For, if the strip 20 is positioned too far away from the apparatus' peripheral base 9, the debris may be spattered above the strip 20. If, on the other hand, the strip 20 is positioned too close to the base 9, the strip 20 may interfere with the operation of the apparatus 10, for example by being swiped by the rotating brushes. In addition, if the strip 20 is too close to the apparatus' peripheral base 9, the cleaning material and debris may be emitted from the apparatus' brushes at such a velocity that they hit the strip 20 and reflect upwardly through the gap, thus spattering the base and other parts of the floor apparatus 10. A minimum distance is necessary also in order to ensure that the guard does not get caught on the floor apparatus 10.

Therefore, it is essential that the two-part connecting means 30 used to secure the two strap ends 22 and 24 together is such that it allows the strap 20 to be easily and quickly adjusted so as to accommodate a variety of different apparatus shapes and sizes, as well as varying rotary brush speeds. In addition, the connecting means 30 must be strong enough to maintain the connection between the strap ends 22 and 24 while the splash guard 5 is pushed along the floor 6 by the apparatus 10.

Figure 3:
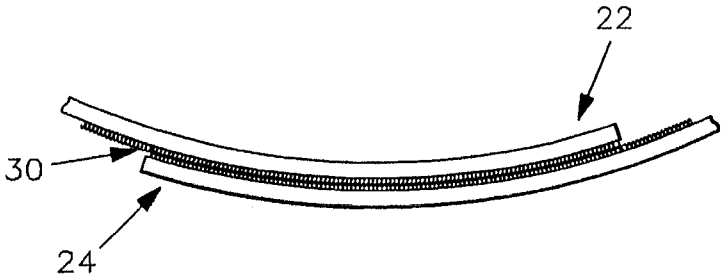
FIG. 3 is a top view of the guard shown in FIG. 1 taken along line 8—8 and particularly showing the attachment means in further detail.

There are numerous possibilities for the connecting means 30 that can be implemented successfully within the scope of the present invention, several of which are illustrated in the figures. In a first preferred embodiment the connecting means 30 consists of surface areas covered with a hook and loop fastener, such as VELCRO®. FIGS. 1, 2 and 3 illustrate the use of this type of fastener, which is especially desirable in that it allows the overlap portions of the ends 22 and 24 to be firmly held in place while providing a means for continuous adjustability so that the splash guard 5 is precisely adjusted to the most functional size for any given application.

Figure 5:
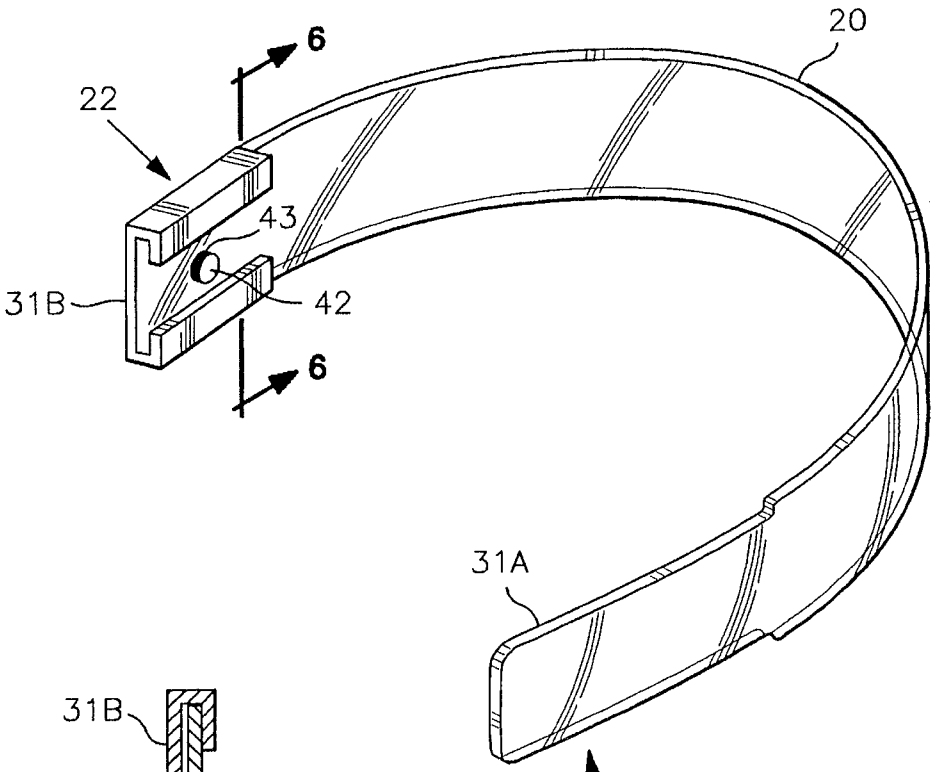
FIG. 5 is a perspective view of another embodiment of the present invention showing a tongue and slot fastening arrangement.
Figure 6:
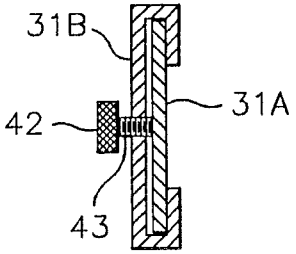
FIG. 6 is a cross-sectional view of the embodiment of FIG. 5 taken along line 6—6 in FIG. 5 and showing the tongue within the slot and a means for fastening same.

In a second preferred embodiment, illustrated in FIGS. 5 and 6, the connecting means 30 consists of a tongue 31A and channel configuration 31B in which one end 22 of the elongated strip 20 includes a C-shaped channel 31B through which tongue 31A at the other end 24 of the strip 20 is inserted. The channel 31B contains a centralized threaded through hole 43, and the tongue 40 has a slightly narrower height than the rest of the strip 20 so that the guard sits evenly on the floor 6. The tongue is reduced height allows it to be easily secured within the channel 31B without the bottom edge 28 of the strip 20 breaking contact with the floor 6. Once the tongue 31A is appropriately positioned within the channel 31B, a screw 42 or like fastener is treaded into the hole 43 so that it firmly contacts and secures the tongue 31A within the channel 31B.

Figure 7:
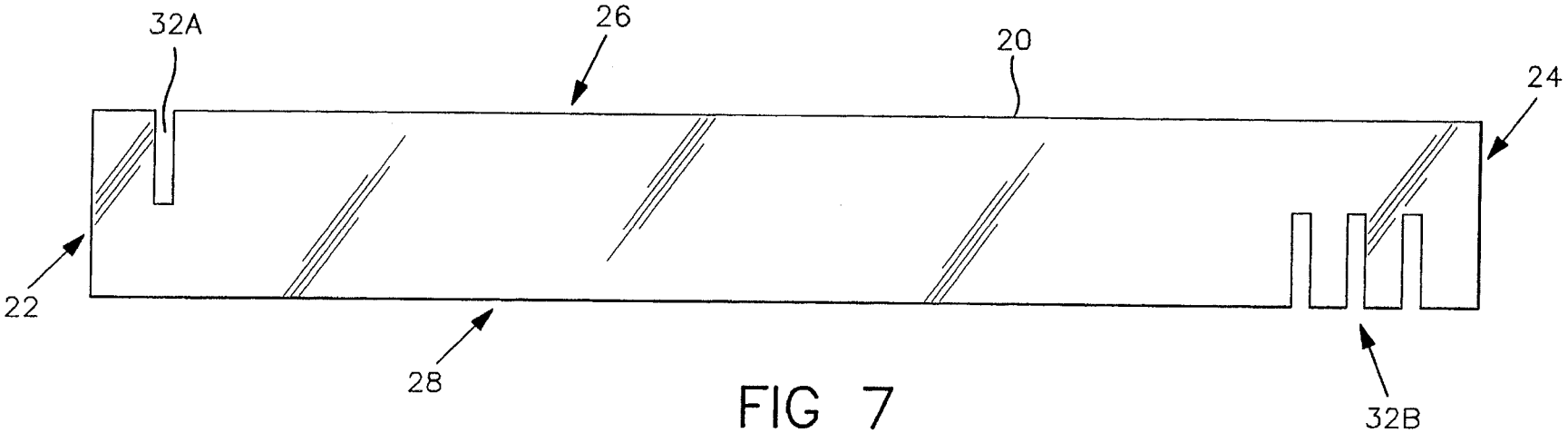
FIG. 7 is an alternate design for the present invention.

In another embodiment, illustrated in FIG. 7, the connecting means 30 consists of at least one slot 32A positioned at one end 22 of the strip 20 and a series of spaced slots 32B positioned at the other end 24 of the strip. The slot 32A at one end 22 extends downwardly from the top edge 26 approximately half-way through the width of the elongated strip 20, while the series of spaced slots 32B at the other end 24 extends upwardly from the strip's bottom edge 28. Thus, to secure the ends together, the one slot 32A is simply interconnected with a chosen one of the slots 32B on the other end 24 of the strap 20. In this manner the strip 20 is formed and held in a circular shape, but has the drawback of not being continuously adjustable.

Figure 8:
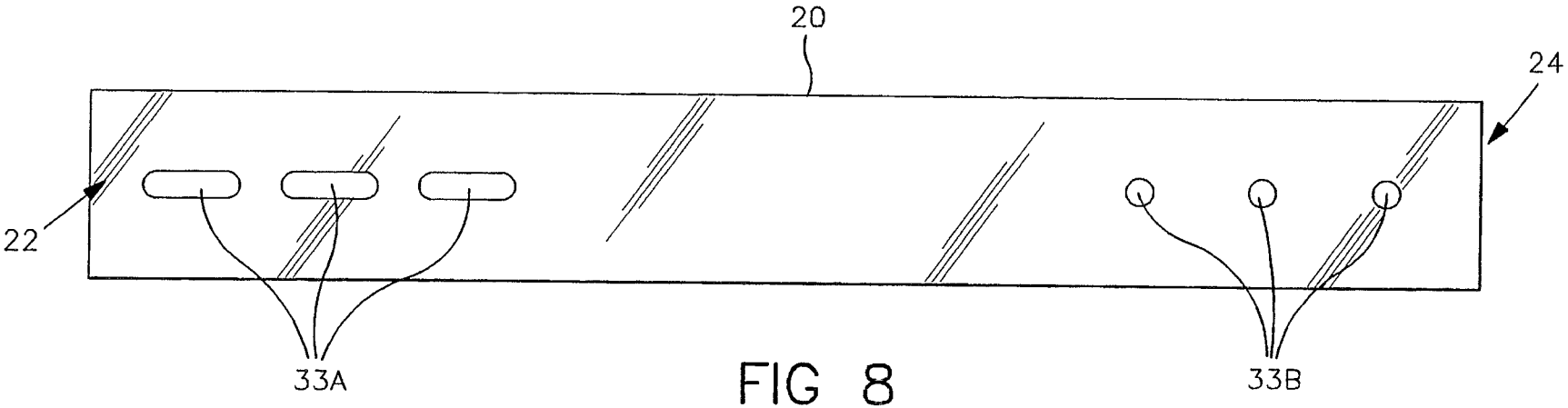
FIG. 8 is yet another alternate design for the present invention.

In another embodiment, shown in FIG. 8 the connecting means 30 comprises a series of clearance slots 33A that are formed as a linear array at one end 22 of strip 20, plus a series of equally spaced holes 33B formed as a liner array at the other end 24 of strip 20. To fasten the ends 22 and 24 together, the appropriate corresponding openings 33A and 33B of each end 22 and 24 are aligned, and fastened with screws, rivets or other common fastener means, (not shown). Because of the elongated holes, i.e., slots 33A, this embodiment is able to be adjusted more or less continuously, over a short range of positions.

While the invention has been described with reference to preferred embodiments, it is to be clearly understood by those skilled in the art that the invention is not limited thereto. Rather, the scope of the invention is to be interpreted only in conjunction with the appended claims.

What is claimed is:

1. An adjustable splash guard for preventing debris from being thrown from a floor machine apparatus, the guard comprising:

a flexible waterproof elongated strip having two ends capable of overlapping and having an overall length of the elongated strip greater than a peripheral base of the apparatus so that the elongated strip is capable of encircling the apparatus in a closed wall configuration adapting to the general shape of the peripheral base of the apparatus and slightly larger than the peripheral base of the apparatus so that the elongated strip does not interfere with the operation of the apparatus, having a width of the elongated strip, at least as wide as the height of the peripheral base of the apparatus so that the elongated strip is capable of encircling the apparatus to form an enclosed wall extending from the floor up to the height of the peripheral base of the apparatus and thereby capable of retaining splashes of floor treating matter from the apparatus inside the elongated strip, and the elongated strip having at least one straight edge along the length of the elongated strip, which straight edge forms the bottom edge of the elongated strip in use so that the elongated strip is capable of sliding across the floor as the apparatus moves with the bottom edge of the elongated strip maintaining contact with the floor along the entire length of the bottom edge of the elongated strip;

a connecting means for connecting the overlapping ends of the elongated strip in an adjustable and size selectable manner, so that the elongated strip is capable of forming a desired size and maintaining the shape and size while being pushed along the floor by the apparatus, and the connected means is capable of being disconnected and the elongated strip flattened out when not in use.

2. The adjustable splash guard of claim 1 further comprising a low friction strip secured along the bottom edge of the elongated strip which low friction strip is capable of low friction sliding contact with the floor and capable of preventing adherence of floor debris thereon.

3. The adjustable splash guard of claim 2 wherein the low friction strip is fabricated of a moisture resistant polymer fiber having low friction properties.

4. The adjustable splash guard of claim 3 wherein the low friction strip is from ⅛ inch to ¼ inch in height.

5. The adjustable splash guard of claim 3 wherein the connecting means comprises a mating two-part fastener means which is capable of securing together adjustably and removably.

6. The adjustable splash guard of claim 5 wherein the mating two-part fastener means comprises hook and loop surface fastener material.

7. The adjustable splash guard of claim 5 wherein the connecting means comprises a series of mating openings formed in each end of the elongated strip and a fastening means secured removably through a desired pair of the mating openings with the ends overlapping.

8. The adjustable splash guard of claim 5 wherein the connecting means comprises a channel formed at one end of the elongated strip capable of receiving the other end of the elongated strip adjustably and removably secured within the channel.

9. The adjustable splash guard of claim 8 further comprising an opening through the elongated strip in at least one end of the elongated strip, wherein a removable screw means through the opening is capable of binding one end against the other end.

10. The adjustable splash guard of claim 5 wherein the connecting means comprises at least one slot halfway through the width of the elongated strip through one edge adjacent to one end of the elongated strip and a series of spaced slots halfway through the width of the elongated strip through the other edge adjacent to the other end of the elongated strip, wherein the slots at opposite ends are capable of interconnecting removably.

11. The adjustable splash guard of claim 3 wherein the elongated strip is formed of a synthetic extruded material capable of being formed in rolls and cut into elongated strips.

12. The adjustable splash guard of claim 3 wherein the elongated strip is formed of flexible plastic.

13. The adjustable splash guard of claim 3 wherein the elongated strip is formed of sheet material from ⅛ inch to ¼ inch in thickness.

* * * * *